US006578790B1

(12) United States Patent
Campagna

(10) Patent No.: US 6,578,790 B1
(45) Date of Patent: Jun. 17, 2003

(54) DEVICE FOR DISTRIBUTING PAPER SEGMENTS

(75) Inventor: Gianni Campagna, Bologna (IT)

(73) Assignee: C.A.M.P.I. Centro Applicazione Moderni Prodotti Industriali S.r.l., Bologna (IT)

( * ) Notice: Subject to any disclaimer, the term of this patent is extended or adjusted under 35 U.S.C. 154(b) by 8 days.

(21) Appl. No.: 09/712,222

(22) Filed: Nov. 15, 2000

(30) Foreign Application Priority Data

Nov. 19, 1999 (IT) ..... B099A0628

(51) Int. Cl.[7] ..... B65H 43/00; B65H 43/08; B65H 63/06

(52) U.S. Cl. ..... 242/563; 242/564.1

(58) Field of Search ..... 242/563, 410, 242/534, 562, 563.2, 564, 564.1, 565; 271/256, 258.1; 221/26; 225/2, 4, 15; 226/11, 24, 45

(56) References Cited

U.S. PATENT DOCUMENTS 4,119,255 A * 10/1978 D'Angelo ..... 226/136
4,454,973 A * 6/1984 Irvine ..... 225/100
4,946,086 A * 8/1990 Suuronen et al. ..... 225/4
5,076,555 A * 12/1991 Bunch, Jr. ..... 270/39
5,312,021 A * 5/1994 Nelson ..... 222/183
5,350,928 A * 9/1994 Hatchell et al. ..... 225/100
5,947,408 A * 9/1999 Miyake ..... 242/562
6,145,423 A * 11/2000 Boreali et al. ..... 156/353

FOREIGN PATENT DOCUMENTS

EP 0 744 147 A1 11/1996

* cited by examiner

*Primary Examiner*—Donald P. Walsh
*Assistant Examiner*—Mark J. Beauchaine
(74) *Attorney, Agent, or Firm*—Young & Thompson

(57) ABSTRACT

A device for distributing paper segments, comprising a containment structure; at least a continuous roll of paper presenting a plurality of perforations distributed along the direction of unwinding of the roll, the roll developing inside the containment structure until reaching an exterior release area presented by the containment structure itself; means for unwinding the roll towards the release area; at least a detector, positioned downstream of the roll within the containment structure, to identify at least a perforation in the paper roll during the unwinding thereof; and locking means connected to said detector to lock the unwinding of the roll when the perforation is identified.

6 Claims, 1 Drawing Sheet

DEVICE FOR DISTRIBUTING PAPER SEGMENTS

BACKGROUND OF THE INVENTION

The present invention relates to a device for distributing paper segments, in particular segments coming from a continuous roll.

In the field of sheet dispensers applied for instance inside public facilities, such as workshops, petrol stations or car washes, devices are known for distributing sheets of paper or similar materials coming from a continuous roll which is unwound within a containment structure towards a release area, in correspondence with which the user can tear from the continuous roll a segment of the desired size.

Some of these devices lack means able to facilitate the detachment of the paper segments so they present the drawback that, during the tearing phase, the force exerted by the user is not always sufficient completely to detach the sheet from the remainder of the roll. In these devices, therefore, separating a sheet of the desired dimensions and with sufficiently regular edges from the continuous roll is difficult.

Also known are devices that present cutting elements in correspondence with the release area, to favor the tearing effected by the user and to obtain a sheet with more regular edges. These devices, however, do not allow to obtain individual segments of equal dimensions, the dimensions being evaluated by the user who performs the tearing action.

Also known are devices that use paper rolls presenting transverse weakening or incised lines, in order to facilitate the tearing while providing paper segments of regular shape and size.

In these devices, however, a continuous succession of segments, which the user interrupts at his/her own discretion.

To facilitate the tearing, the user must in this case separate the segment in correspondence with the weakening or incised line, which operation can be found difficult because it is necessary to exert a traction on a segment of the roll whilst holding the contiguous segment still, which segment as a result of the exerted traction would tend to unwind towards the release area.

Moreover, to avoid paper wastage, the user has to perform the aforesaid operation in proximity to the release area, in order not to leave a quantity of paper unused outside the dispensing device.

Dispensing devices are known which regulate the exit of the paper segments in relation to the rotation effected by the paper roll during its unwinding; for instance, the unwinding of the paper is interrupted at each rotation of the roll.

Since roll diameter changes during use, it is evident that when the roll is new the quantity of paper unwound is much greater than when the roll approaches exhaustion.

In this situation, the weakening or incised lines do not always align in correspondence with the release area, thus making it difficult to tear off individual segments.

As disclosed in Patent BO95A000258, also known are devices for dispensing paper segments soaked with a cleaning product, which is dispensed on a portion of roll inside the containment structure before an end of the roll itself exits the release area.

Such devices present the drawback that the dispensing of the product is not always effected on the individual paper segment to be selected by the user as it exits, since the unwinding of the roll depends either on the user's intervention or on the adjustment based on the rotation of the roll itself.

In this situation, the cleaning product is dispensed on a surface that does not correspond exactly with the individual segment, so that the user may have available a paper sheet that is only partially soaked with the product.

SUMMARY OF THE INVENTION

The aim of the present invention therefore is to eliminate the aforementioned drawbacks by means of a device for dispensing paper segments which provides, in correspondence with the release area, a segment that can be easily separated from the previous one.

A further aim of the present invention is to prevent subsequent segments from being unwound from the coil as a result of the traction exerted on a first segment to be used.

Another aim of the present invention is to lock the unwinding of the roll when the weakening or incised line is in correspondence with the release area.

The present invention also allows to position the single segment in correspondence with a possible apparatus for dispensing cleaning product located inside the containment structure.

These aims and others besides, which will become more readily apparent in the description that follows, are achieved in accordance with the present invention by a device for dispensing paper segments, comprising a containment structure; at least a continuous roll of paper presenting a plurality of perforations distributed along the direction of unwinding of the roll, said roll developing inside said containment structure until reaching an exterior release area presented by the containment structure itself; and means for unwinding said roll towards the release area, comprising at least a detector, positioned downstream of the roll inside the containment structure, to identify at least a perforation in the paper roll during the unwinding thereof and locking means connected to said detector to lock the unwinding of the roll when said perforation is identified.

BRIEF DESCRIPTION OF THE DRAWINGS

Further technical features and advantages of the invention shall become more readily apparent from the detailed description that follows, made with reference to the accompanying drawings, which represent embodiments provided purely by way of non limiting examples, in which.

DESCRIPTION OF THE PREFERRED EMBODIMENTS

Figure 1:
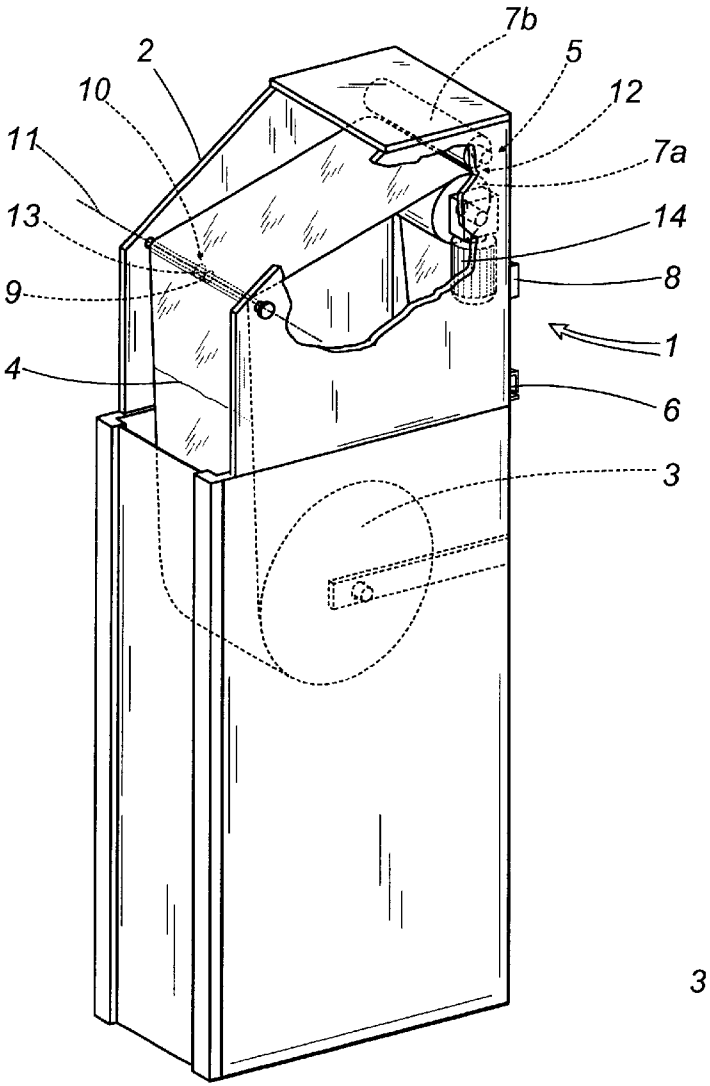
FIG. 1 shows a perspective view of the subject device.

In accordance with the figures of the accompanying drawings, the reference number 1 indicates a device for dispensing paper segments. The device 1 comprises a containment structure 2, within which is positioned a continuous roll 3 of paper.

In the device according to the invention, the paper roll 3 presents a plurality of perforations 4 distributed along the direction of unwinding of the roll, defining for instance weakening or incised lines, transverse relative to the development of the roll.

The roll 3 is unwound by unwinding means 5 towards release area 6, for instance a slot obtained in the containment structure 2. The unwinding means 5 can be constituted by a pair of rollers 7*a*, 7*b* through which is inserted an end of the roll 3 to be unwound towards the release area 6.

In the embodiment of FIG. 1, a roller 7*a* is connected to a motor 14 for the automatic and non manual unwinding of the roll 3.

This actuation can be obtained by acting on an element outside the containment structure 2, for instance a pushbutton or lever 8, or preferably a coin machine reading card.

In accordance with the present invention, the device 1 is provided with a detector 9, for instance an optical sensor, positioned downstream of the roll 3 inside the containment structure 2, to identify at least a perforation 4 in the roll 3 itself as it unwinds towards the release area 6.

The device further comprises a retractor element 10 for widening the perforation 4 and favoring the identification of the perforation 4 by the detector 9.

Figure 2:
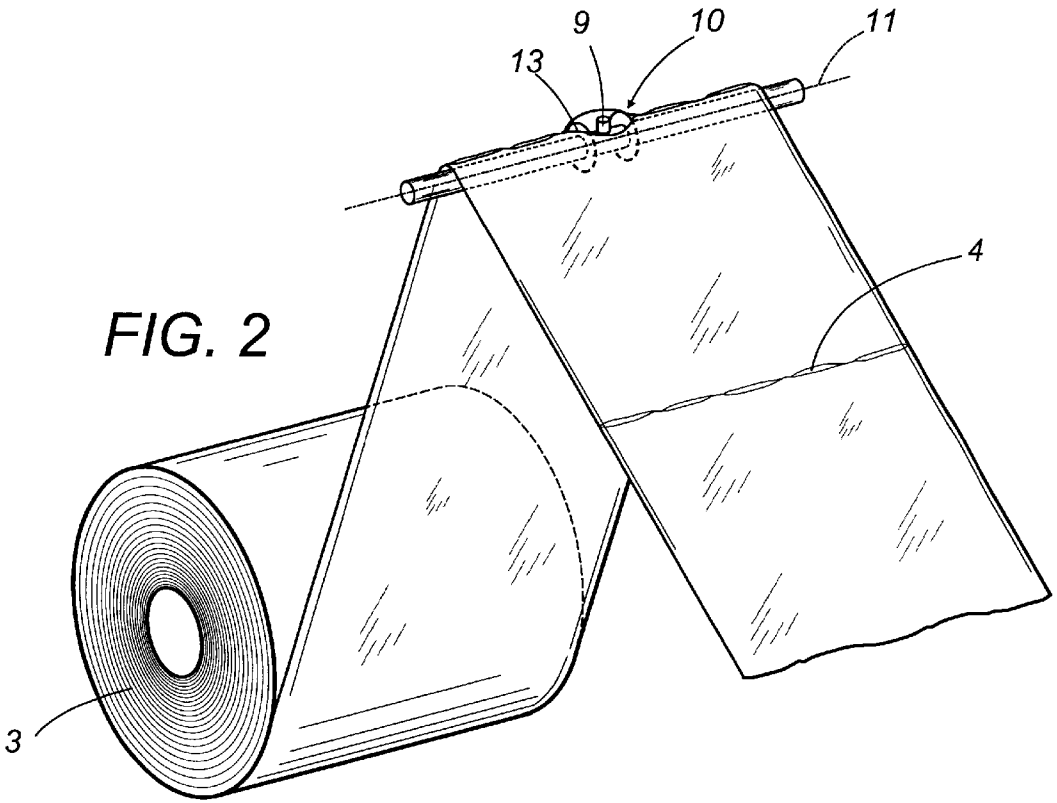
FIG. 2 shows a detail of the detector of the subject device in perspective view.

In the embodiment illustrated in FIG. 2, the detector 9 and the retractor element 10 are supported by a spindle 11 parallel to the axis of the roll 3.

The retractor element 10 comprises a pair of disks 13 which rotate on the spindle 11. When the roll 3 is unwound and the paper passes over the spindle 11 and on the disks 13, by effect of the difference in diameter between disks 13 and axis 11, which would force the paper to a longer path in correspondence with the disks, the paper itself spreads in the area presenting at least a perforation 4 allowing the sensor 9 to detect the point of discontinuity in the paper roll.

The device of the invention further comprises locking means 12, connected to the detector 9, to lock the unwinding of the roll 3 when a perforation 4 is identified.

In the case of a manual operation of the unwinding means 5, the user exerts a traction on an end of the paper roll 3 projecting from the release area 6. In this way, the rollers 7*a*, 7*b* for the unwinding of the roll 3 are set in rotation and cause the roll 3 to be unwound within them.

During the unwinding of the roll 3, the perforations 4 slide following the direction of development of the roll 3. When one of the perforations 4 is in correspondence with the retractor element 10, it is widened by the disks 13 mounted on the axle 11, so that the sensor 9 can detect a discontinuity, in practice the absence of paper, in that given point.

The sensor 9 then sends a signal to the locking means 12 which act on the rollers 7*a*, 7*b*, preventing the rollers 7*a*, 7*b* from rotating and thus the roll 3 from being unwound within them.

In correspondence with the release area 6, a single paper segment appears, whose weakening area is in proximity to the slot, and which can therefore easily be separated from the contiguous segment of the roll which is held still by the locking action exerted on the unwinding rollers 7*a*, 7*b*.

In case of automatic operation of the unwinding means 5, as shown in FIG. 1, the user activates the unwinding of the roll 3 acting on the pushbutton, or lever, 8. When one of the perforations is detected, the locking means 12 connected to the sensor 9 stop the operation of the motor 14 of the unwinding roller 7*a* preventing its rotation.

The dispensing device according to the invention thus allows to provide a single paper segment in the release area which can easily be separated from the continuous roll.

The segments thus provided have predetermined size and regular shape since the separating operation does not entail tearing and occurs exactly in correspondence with the weakening or incised line.

Moreover, the roll stops unwinding when a single segment is in the release area, so that the user needs only to exert a traction on the external paper segment, without intervening on the roll to hold it still.

The stopping of the roll in a predetermined position also allows to effect the dispensing of a possible cleaning product exactly in correspondence with the surface of a single segment, which therefore exits from the release area completely soaked with the selected segment.

Additionally, only a segment at a time is provided in the release area, thereby limiting paper wastage.

If the user wants to obtain multiple contiguous paper segments, he/she should simply exert a traction on the segment following the first in case of manual operation, or activate the unwinding means again by means of the pushbutton located outside the containment structure.

The invention thus conceived can be subject to numerous modifications and variations, without thereby departing from the scope of the inventive concept. Moreover, all components can be replaced by technically equivalent elements.

What is claimed is:

1. A device for distributing paper segments, comprising a containment structure; at least a continuos paper roll presenting a plurality of perforations distributed along the direction of unwinding of the roll, said roll developing inside said containment structure until reaching an exterior release area presented by the containment structure itself; means for unwinding said roll towards the release area, comprising at least a detector, positioned downstream of the roll inside the containment structure, to identify at least a perforation in the paper roll during the unwinding thereof and locking means connected to said detector to lock the unwinding of the roll when said perforation is identified; a retractor element operating on at least one of said perforations to widen said perforation and favor the identification of said perforation by said detector; wherein said detector and said retractor element are supported by a spindle parallel to the axis of the roll.

2. A device as claimed in claim 1, wherein said retractor element comprises at least a disk mounted rotatively on said spindle.

3. A device as claimed in claim 1, wherein said retractor element comprises at least a pair of disks mounted rotatively on said spindle.

4. A device as claimed in claim 1, wherein said retractor element is an optical sensor.

5. A device as claimed in claim 1, wherein said means for unwinding the roll can be actuated from outside the containment structure.

6. A device as claimed in claim 1, wherein said locking means are constituted by the unwinding means themselves.

* * * * *